US007036180B2

(12) United States Patent
Hanlon

(10) Patent No.: US 7,036,180 B2
(45) Date of Patent: May 2, 2006

(54) TOOTH BRUSH WITH FOUR BRISTLE GROUPS

(76) Inventor: Barbara Hanlon, 4728 Carroll Manor Rd., Baldwin, MD (US) 21013

( * ) Notice: Subject to any disclaimer, the term of this patent is extended or adjusted under 35 U.S.C. 154(b) by 0 days.

(21) Appl. No.: 10/916,319

(22) Filed: Aug. 11, 2004

(65) Prior Publication Data

US 2005/0015908 A1 Jan. 27, 2005

Related U.S. Application Data

(63) Continuation-in-part of application No. 10/269,835, filed on Oct. 11, 2002, now abandoned.

(60) Provisional application No. 60/361,432, filed on Feb. 28, 2002, provisional application No. 60/328,511, filed on Oct. 11, 2001.

(51) Int. Cl.
*A46B 9/04* (2006.01)

(52) U.S. Cl. ..... 15/167.2; 15/106; D4/105; D4/106

(58) Field of Classification Search ..... 15/106, 15/167.1, 167.2; D4/105, 106
See application file for complete search history.

(56) References Cited

U.S. PATENT DOCUMENTS 2,155,245 A * 4/1939 Ioji ..... 15/167.1
2,214,407 A * 9/1940 Andreas ..... 15/167.2
2,244,615 A * 6/1941 Louis ..... 15/167.2
2,528,992 A * 11/1950 Barr ..... 15/167.2
D325,821 S * 5/1992 Schwartz ..... D4/106
5,327,607 A * 7/1994 Wagner ..... 15/167.2
5,497,526 A * 3/1996 Klinkhammer ..... 15/167.2

FOREIGN PATENT DOCUMENTS

AU 102844 * 12/1937
GB 449836 * 7/1936

* cited by examiner

*Primary Examiner*—Mark Spisich
(74) *Attorney, Agent, or Firm*—Law Offices of Royal Craig

(57) ABSTRACT

A toothbrush for use on domestic pets, comprising a toothbrush head with each end curved upward at roughly 30 degree angles, and four sets of soft bristles attached to the head. Three sets of bristles are attached to the front face of the brush head, with two sets positioned opposite each other on each upward curved end of the head and the third set of bristles positioned in the center in the middle region, perpendicular to the toothbrush head between the other two sets, thereby providing coverage of the mesial, distal and occlusal surfaces of the teeth simultaneously. The fourth set of bristles is attached to the back side of the toothbrush head, thereby propping open the jaw and softening the bite while cleaning and massaging the opposing teeth at the same time that the other three sets of bristles are doing the primary cleaning. The toothbrush handle is attached to the center of the head for ease of use and the ability to reach the back molars.

12 Claims, 4 Drawing Sheets

TOOTH BRUSH WITH FOUR BRISTLE GROUPS

CROSS-REFERENCE TO RELATED APPLICATIONS

The present application is a continuation-in-part of U.S. application Ser. No. 10/269,835, filed 11 Oct. 2002, abandoned which application derives priority from the following provisional applications:

(1) Ser. No. 60/328,511, filed Oct. 11, 2001, entitled Toothbrush with Multi-directional Bristle Groups, and (2) Ser. No. 60/361,432, filed Feb. 28, 2002, entitled Toothbrush with Four Bristle Groups.

BACKGROUND OF THE INVENTION

1. Field of the Invention

The present invention relates generally to devices for the care of teeth of domestic animals and more particularly, to a toothbrush for comprehensive cleaning of the teeth of such animals, and comprising a toothbrush head with four distinct sets of bristle tufts, each set having a distinct purpose.

2. Description of the Background

It is well known that cats and dogs should have their teeth brushed to prevent build up of tartar and plaque along the outer surfaces and in the interproximal areas between the teeth, which can lead to gum disease, tooth loss, and unpleasant smelling breath. Many pet owners are reluctant to clean their pet's teeth because of the time it takes and the difficulty in brushing, particularly as the brushing progresses and the pet becomes agitated. In lieu of brushing the pet's teeth, many pet owners take their pets to the veterinarian for brushing where the teeth cleaning process often includes sedatation.

Many of the available toothbrushes have only one head with one set of bristles. Yet, the prior art is replete with variations of toothbrushes that attempt to vary the formation of the toothbrush and/or the bristles to improve the effectiveness of the toothbrush. These examples, however, are designed for human use, and are not particularly suited for pets as they do not allow for simultaneous full coverage of the mesial, distal and occlusal surfaces of the teeth, while cleaning and massaging the opposing teeth, and propping the animal's jaw open, at the same time. These features are particularly beneficial when brushing pets' teeth because of the need to thoroughly clean the teeth as quickly as possible before the pet becomes too agitated.

For example, U.S. Pat. No. 6,276,021 to Hohlbein shows a toothbrush having a plurality of peripheral bristle tufts and a plurality of adjacent bristle bars located internally within the toothbrush head, to provide support for the peripheral bristle tufts during brushing.

U.S. Pat. No. 2,214,407 to A. A. Deutsch, issued in 1940 and now expired, discloses a brush head made in three parts, wherein the end bristles on the longitudinal sides of the lateral bristle carriers are longer than the middle groups of bristles in these parts.

U.S. Pat. No. 5,305,491 to Hegemann discloses a toothbrush having three brush heads that self-adjust to maintain contact with the surfaces of the teeth and the gums. The three brush heads are independently attached to a single handle through elongated flexible arms and adjust independently to maintain contact with the surfaces of different size teeth and gums.

U.S. Pat. No. 2,528,992 to Barr, issued in 1950 and now expired, discloses a toothbrush having at one end a centrally disposed flat bar that supports the outwardly extending arms arranged in V-formation at an angle to the plane of the bar, a pair of transversely extending head members in T-formation at the ends of said arms, with opposed inwardly projecting bristle tufts whose adjacent ends are slightly further apart at the outsides of the tufts than at the inner sides, and at the opposite end of the handle, a transversely extended U-shaped arm which supports the longitudinally extending brush heads on its opposite ends, which support the inwardly directed bristle tufts.

U.S. Pat. No. 5,497,526 shows a tooth brushing device in which the handle has a pair of elongated arms and cowling on the distal end, whose arms extend from the handle generally parallel to each other with a slot in between. The cowling bridges the slot and has an inverted U-shaped body with fields of bristles on the inwardly directed surfaces of the cowling.

Likewise, U.S. Pat. No. 5,673,454 to Quintilla, et al. shows three separate brush heads, a right, a left and center, each attached to a separate arm and each arm glued to an elongated handle.

U.S. Design Pat. No. 325,821 discloses the design of a toothbrush with six distinct sets of bristles.

Finally, GB 449,836 to Richards shows a dental brush with a pair of opposed sets of bristles held in a U or V shaped yoke or stock whose outer ends abut or nearly abut, and one set of bristles on the outside and one set of bristles on the inside of the arch of the yoke or stock.

Unfortunately, none of the prior art devices offer certain improvements nor address certain deficiencies for pet use, none are designed particularly for use on domestic pets, addressing the idiosyncrasies of brushing pet's teeth. Therefore, there remains a need for, and it would be greatly advantageous to provide, a pet toothbrush with four sets of bristle tufts attached to the toothbrush head for thorough and efficient teeth cleaning. The toothbrush comprises an elongate handle with a head attached perpendicular to the handle in a T-formation. The toothbrush head comprises three distinct regions, i.e., a middle region and two respective angled end regions. The two angled end regions are each set at roughly a 30 degree angle to the face of the middle region. Two sets of bristles are attached to the front of the toothbrush head on the angled end regions, opposite each other at roughly a 30 degree angle to the face of the head, to cover the mesial and distal surfaces of the teeth, and the third set of bristles protrudes from the middle region, i.e., the center of the face of the toothbrush head, perpendicular to the first two bristle sets to cover the occlusal surface of the teeth, and the fourth set of bristles is attached to the back of the toothbrush head for cleaning and massaging opposing teeth, and for aid in propping the animal's jaw open while softening the bite during cleaning.

SUMMARY OF THE INVENTION

It is, therefore, an object of the present invention to provide a toothbrush for brushing domestic animals' teeth wherein two sets of bristles are set opposite each other to cover the mesial and distal portions of the teeth.

It is another object to provide a toothbrush for brushing domestic animals' teeth wherein a third set of bristles is attached to the face of the toothbrush head, spaced perpendicular to the first two sets of bristles to cover the occlusal surface of the teeth.

It is another object to provide a toothbrush for brushing domestic animals' teeth wherein a fourth set of bristles is attached to the back side of the toothbrush head to massage and clean the occlusal surface of opposing teeth and to aid in propping open the pet's jaw while brushing.

It is still another object to provide a toothbrush for brushing domestic animals' teeth wherein the handle is attached to the center of the toothbrush head to position the toothbrush head to allow for reaching the back molars.

It is another object to provide a toothbrush as described above that is sturdy, and yet economical to manufacture.

It is another object to provide a toothbrush with soft bristles.

It is still another object to provide a toothbrush that allows for thorough brushing of pets' teeth.

It is yet another object to provide a mechanism as described above that is efficient, enabling the person brushing the teeth to complete the process thoroughly, yet quickly.

It is still another object to provide a toothbrush that helps to keep the jaw open while softening the bite of a domestic animal.

According to the present invention, the above-described and other objects are accomplished by providing a toothbrush wherein the toothbrush head contains four distinct sets of soft bristles. Three of the sets of bristles are attached to the front face of the toothbrush head, with two angled opposing sets of soft bristles to cover the mesial and distal surfaces of the teeth and a third set in the middle of the toothbrush head between the other two sets and perpendicular to the handle, to cover the occlusal surface of the teeth. The fourth set of bristles is attached to the middle of the back side of the toothbrush head to massage and clean the opposing teeth and to aid in propping the animal's jaw open, while the three sets of bristles on the front side are performing the primary cleaning. A particular toothbrush and bristle configuration facilitates the positioning of three distinct sets of bristles on the front face of the head of the toothbrush, and one set of bristles on the back side of the toothbrush head, within a pet's mouth to maximize maneuverability and cleaning effectiveness. The toothbrush handle is attached to the center of the toothbrush head to enable the toothbrush to extend to the back molars. Given the foregoing configuration, the toothbrush can brush the mesial, distal and occlusal surfaces of the teeth at the same time, while massaging and cleaning the opposing teeth and propping the jaw open, therefore, facilitating comprehensive cleaning, ease of use and quicker brushing time.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
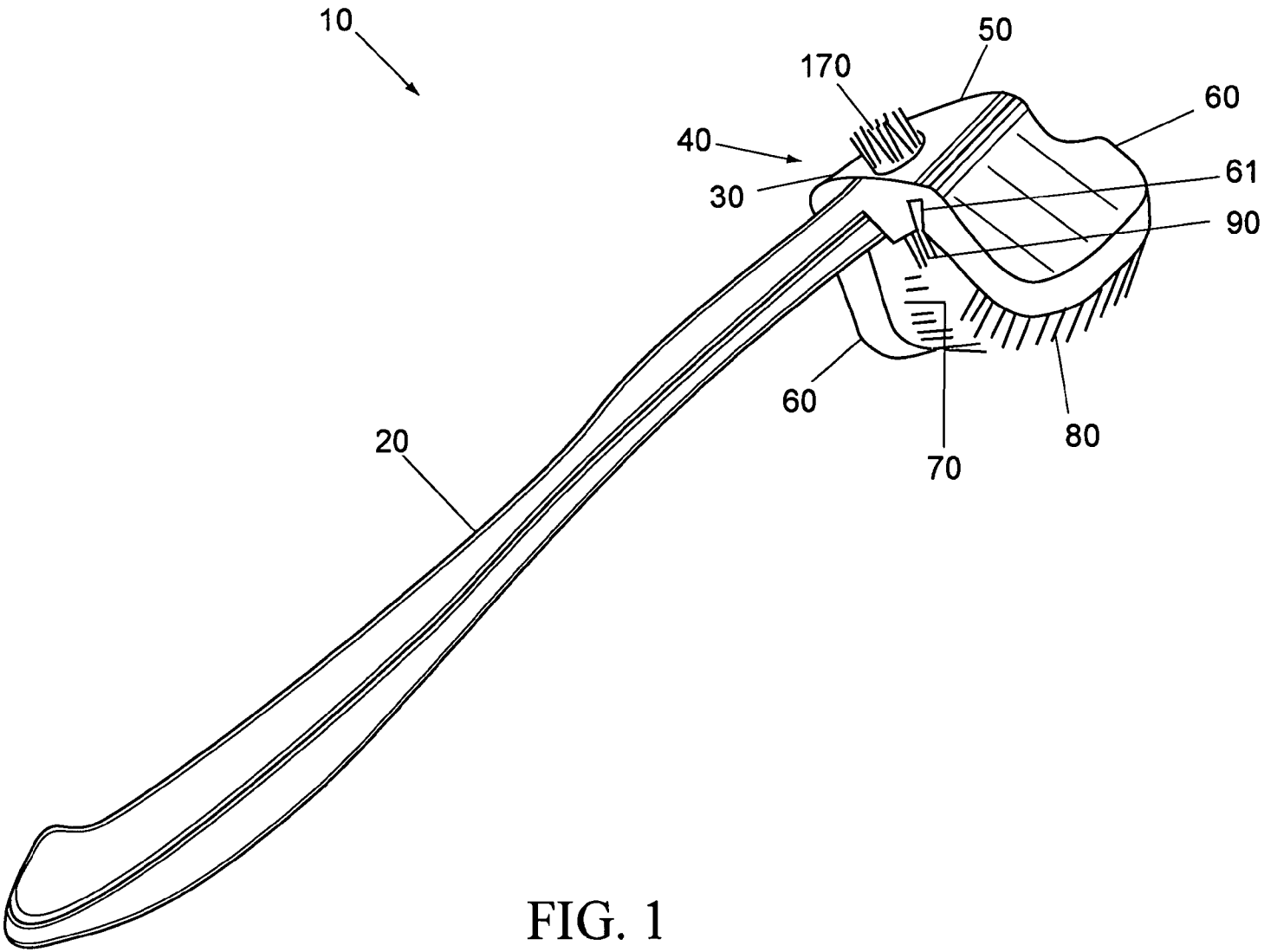
FIG. 1 is a perspective view of the toothbrush with bristle tufts.

FIG. 1 is a perspective view of the toothbrush 10 with bristle tufts according to the present invention. The toothbrush of FIG. 1 facilitates the positioning of three distinct sets of bristles on the front face of the head of the toothbrush, and one set of bristles on the back face of the toothbrush head, all in a particular configuration to maximize maneuverability and cleaning effectiveness. The particular illustrated embodiment comprises a plastic handle 20. The toothbrush user grips the handle 20 between thumb and forefinger whereby the toothbrush can be comfortably held and easily moved into the mouth and along the surface of the teeth. The handle 20 is integrally-molded or otherwise attached to the head 40 of the toothbrush at the center of the head 40 in a T-formation. The head 40 is relatively narrow, flares out laterally and on either side (as will be described) of the handle 20 and at an angle relative thereto, joining the head 40 in the center. Positioning the handle 20 in the center of the head 40 allows the toothbrush to enter the mouth at the appropriate angle for reaching the back molars.

In more detail, the toothbrush head 40 comprises a relatively narrow and flat laterally protruding base 30. The base 30 has opposing spaced ends 60 each of which are relatively narrow, preferably about 10 mm×15 mm, flaring out approximately 5 mm on either side of handle 20, and angling upward by approximately 30 degrees on either side (relative to the plane of the handle 20). This configuration creates three distinct regions, the two upwardly angled ends 60 and a middle region 50. In the illustrated embodiment, each discrete region measures roughly one half inch in length for use on small dogs and cats. These particular toothbrush dimensions may vary somewhat for larger dogs.

Each upwardly angled end 60 is joined to the middle region 50 at a junction defined by a transverse notch 61 on the top face of the respective end 60 adjacent to the middle region. The notch 61 comprises a shallow-angle groove that may be integrally-molded or otherwise formed in the top face between the respective end 60 and the middle region 50 to provide more resilience to the upwardly angled ends 60, allowing them to better conform and straddle a row of teeth no matter the size. The notch 61 effectively serves as a built-in shock absorber to make brushing more comfortable to the pet, and to avoid breakage of the head in the pet's mouth.

Three distinct bristle formations are embedded in the front face of the head 40, including a first set 90 protruding upward from the flat base of the middle region 50 in a circular formation for brushing the occlusal surface of the teeth, and a second and third set 70, 80 each protruding inwardly from the respective angled ends 60 in a rectangular formation to brush the mesial and distal surfaces of the teeth. The length and density of bristles of the circular first set of bristles 90 protruding from the middle region 50 is less than the length and density of bristles of the rectangular second and third sets of bristles protruding from the opposing angled ends. Specifically, each of the second and third sets comprise a rectangular formation of bristles arranged in distinct rows of bristles, the innermost row closest to and/or abutting the middle region being shorter in length than the next adjacent row, which is shorter in length than the next adjacent row, thereby creating a graduated bristle formation increasing in length from the innermost to the outermost row. The outermost row of the circular first set of bristles 90 of the middle region 50 converge and abut or nearly abut the distal end of the innermost row of second and third set of bristles 70, 80 of the tops of the remaining rows of bristles diverging at approximately a 50–60 degree angle. The specific configuration of the first-through-third bristle sets herein described conform to a row of teeth to cover multiple surfaces of the teeth simultaneously. The particular configuration, including dimensions and angular orientation of the toothbrush head 40 enable the user to comfortably manipulate it inside the dog or cat's mouth so that all front and back teeth may be reached.

A fourth set of bristles is embedded in the back face of the middle region 50 of the toothbrush head 40 in a circular formation for massaging and cleaning the opposing teeth while the front bristles are performing the primary cleaning. This fourth set of bristles is approximately 5 mm long, and also serves to prop the pet's mouth open while brushing, the bristles creating a soft cushion for the opposing jaw. To use the brush, the user simply pushes and drags it across each row of the pet's teeth, maintaining the middle region 50 of the flat base 30 generally parallel to the occlusal surface of the teeth, such that all of the occlusal, mesial and distal surfaces of all of the teeth are thoroughly cleaned.

Figure 2:
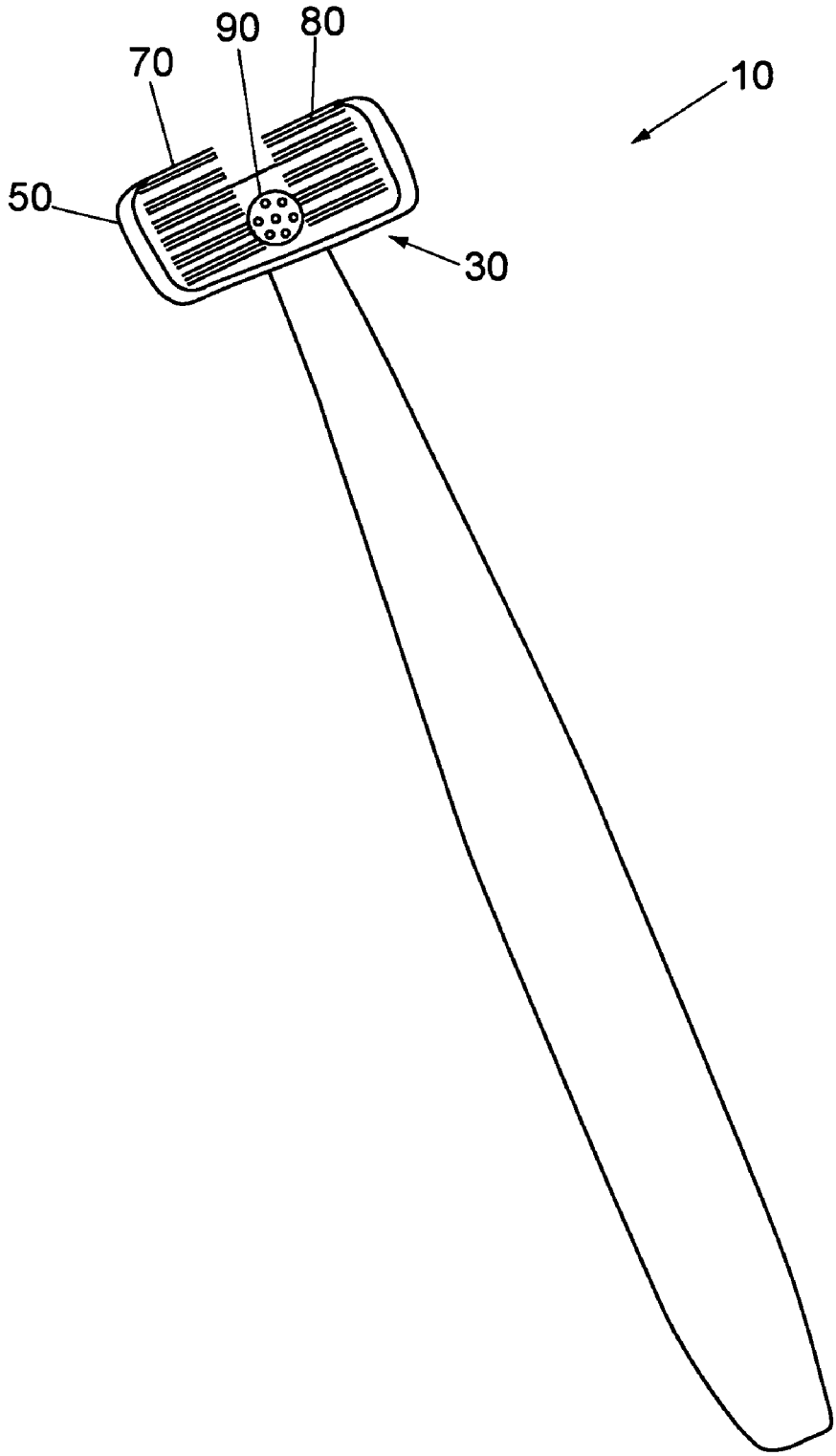
FIG. 2 is a front view of the four-tufted toothbrush as in FIG. 1, illustrating three sets of bristle tufts attached to the front of the toothbrush head; two sets positioned opposite each other at an angle and the third set perpendicular to the face of the head.

FIG. 2 is a front view of the four-tufted toothbrush as in FIG. 1, illustrating the first through third sets of bristle tufts attached to the front face of the toothbrush head; the second and third sets 70, 80 positioned diametrically opposite each other and the first set 90 extending perpendicularly from the middle region 50 between the other two sets. The second set of bristle tufts 70 brushes the mesial surface of the tooth. The third set of bristle tufts 80, opposite the second set, brushes the distal surface of the teeth. The first set of bristle tufts 90, in the center of the toothbrush head 40, brushes the occlusal or top surface of the teeth. This configuration allows for simultaneous brushing of all three surfaces of the teeth. A fourth set of bristles 170 is attached to the back side of the toothbrush head for concurrent massaging and cleaning of the opposing teeth, and for aid in propping open the pet's jaw, while softening the bite.

Figure 3:
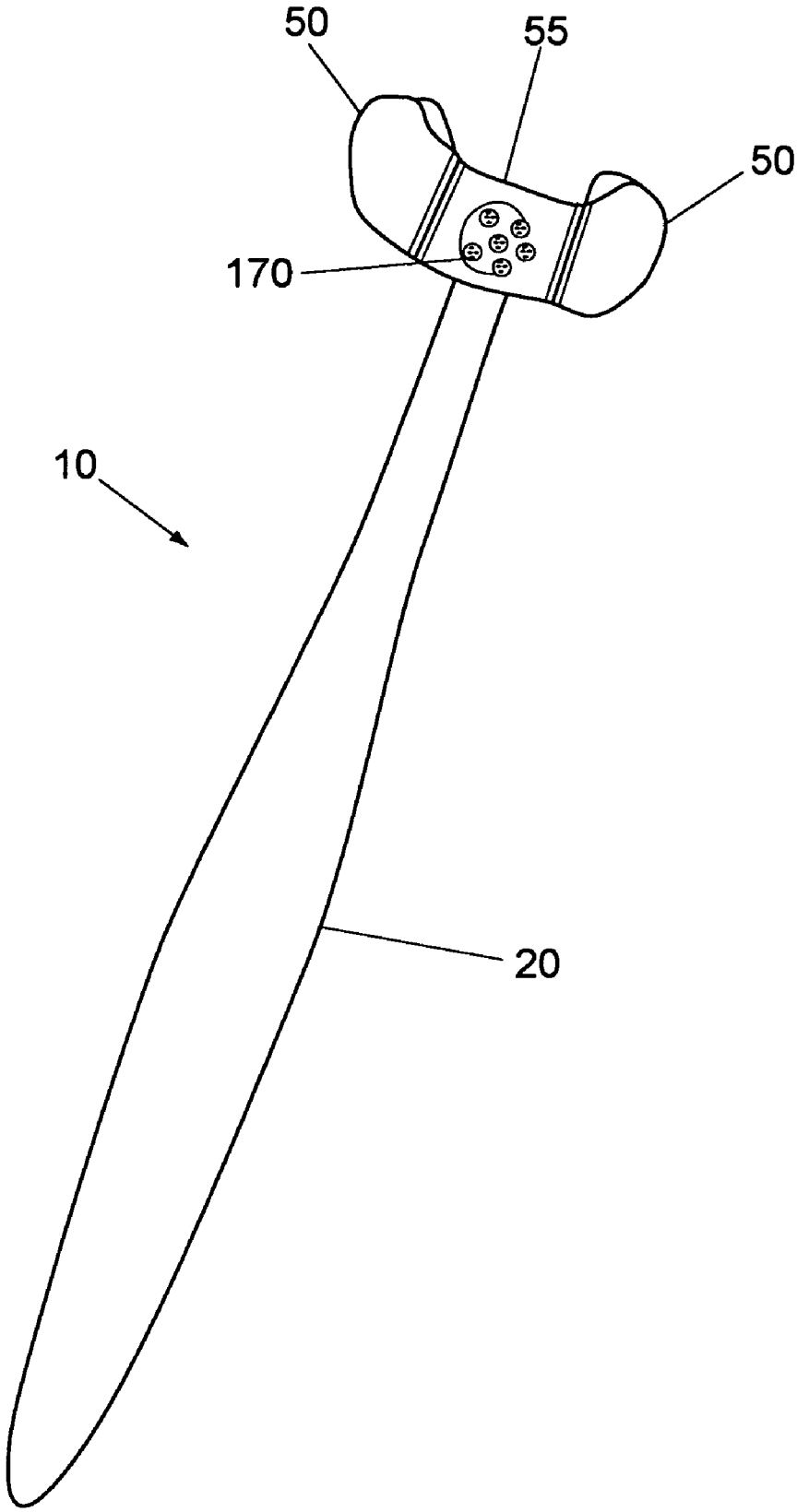
FIG. 3 is a rear view of the four-tufted toothbrush as in FIG. 1 with the fourth set of bristles attached to the back side of the toothbrush head.

FIG. 3 is a rear view of the four-tufted toothbrush as in FIG. 1 illustrating the fourth set of bristles attached to the back side of the toothbrush head. The fourth set of bristles 170 are embedded in the back side of the toothbrush head 40 and is configured in an oval or circle in the center of the toothbrush head. This fourth tuft of bristles 170 on the back of the brush massages and cleans the opposing teeth at the same time that the three bristle tufts on the front side of the brush are performing the primary cleaning of the teeth; e.g., if the bottom teeth are being cleaned, the top teeth are massaged and cleaned by the fourth tuft of bristles at the same time. The fourth tuft also helps to keep the jaw open while brushing the back molars and softens the bite as the pet tried to bite down on the brush. The configuration and dimensions of said toothbrush head enables the toothbrush head to comfortably fit inside the mouth and easily reach the front and back teeth, and top and bottom teeth.

Figure 4:
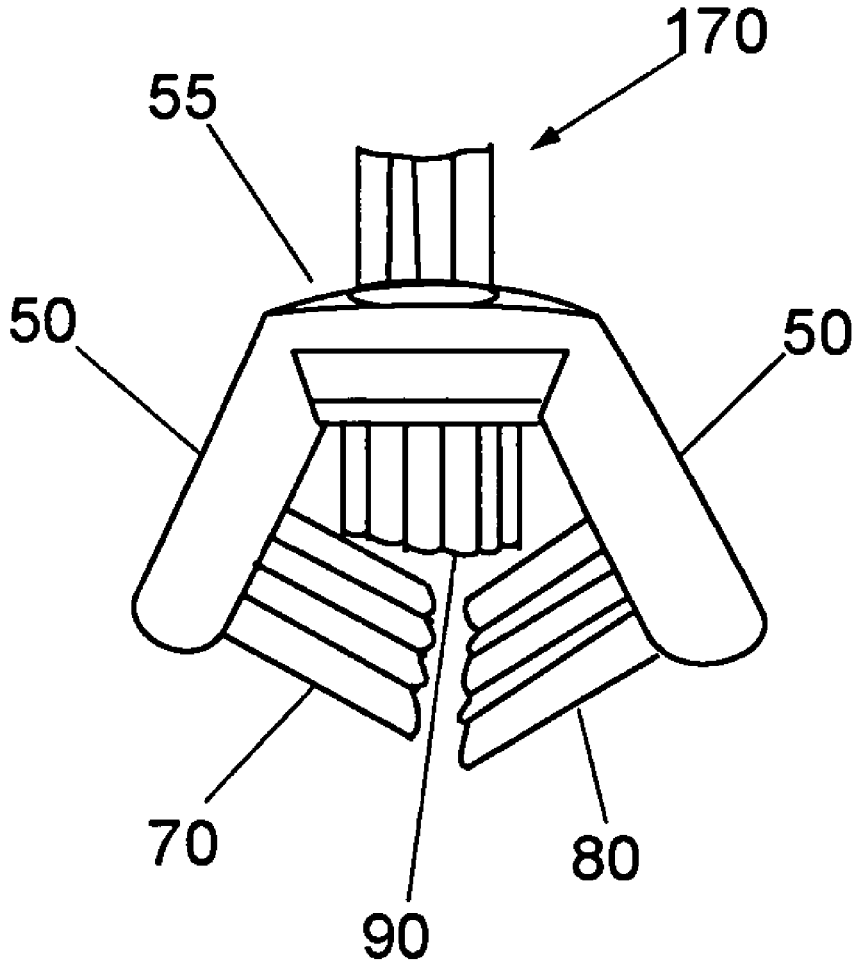
FIG. 4 is a side view of the four-tufted toothbrush as in FIG. 1.

FIG. 4 is a side view of the four-tufted toothbrush as in FIG. 1. All four sets of bristles are embedded in the toothbrush head 40 in a known manner. The first, second, and third set of bristles are attached to the front face of the toothbrush head 40. The fourth set of bristle tufts 170 is attached to the back face of the toothbrush head 40.

The foregoing design thoroughly cleans the mesial and distal portions of the teeth, as well as the occlusal surface of the teeth, while simultaneously massaging and cleaning the occlusal surface of opposing teeth, and softening the bite while aiding in propping open the pet's jaw. Moreover, the handle configuration which is attached to the center of the toothbrush head allows easy reach to the back molars. This degree of comfort and efficiency is extremely important for dogs and cats where patience tends to wear thin very quickly and the animal can get anxious and agitated, and possibly try to bite the person trying to brush its teeth. The present invention is both sturdy and resilient, and yet economical to manufacture.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A toothbrush for cleaning domestic pets' teeth comprising:

a handle;

a toothbrush head fixedly attached to said handle, said head further including, a substantially flat base protruding transversely in a T-formation from said handle to opposing ends protruding outward from said base at an angle, said handle being integrally attached to a midpoint of said base, and both of said ends being integrally attached to said base at a junction defined by a transverse notch for providing resiliency, whereby said ends are flared and angled upward from said base, creating three distinct regions, a middle region and two angled ends;

a first circular set of bristle tufts fixedly attached to said middle region of said base and extending perpendicularly from said middle region between said opposing ends for cleaning an occlusal surface of the teeth;

second and third sets of bristle tufts fixedly attached to said respective upwardly angled ends of said base diametrically opposite each other, wherein said second and third sets of bristle tufts extend inward toward each other for cleaning mesial and distal surfaces of the teeth, said first, second and third sets of bristle tufts converging inward to conform to a row of teeth, and a fourth circular set of bristle tufts fixedly attached to the rear surface of said base opposite said first set of bristle tufts to clean and massage the opposing tooth and to prop open the jaw;

whereby said toothbrush simultaneously engages the mesial, distal, and occlusal surfaces of the teeth and maintains said jaw open for a softer bite during the cleaning process.

2. The toothbrush according to claim 1, wherein said base is approximately 1½ inches long.

3. The toothbrush according to claim 2, wherein each of said angled ends is approximately ½ inch long.

4. The toothbrush according to claim 3, wherein said middle region is approximately ½ inch long.

5. The toothbrush according to claim 1, wherein said angled ends are within a range of from 30–45 degrees relative to said middle region.

6. The toothbrush according to claim 1, wherein said second and third sets of bristle tufts each comprise multiple rows of bristles in a rectangular formation.

7. The toothbrush according to claim 6, wherein said rows of bristles are of graduated length.

8. The toothbrush according to claim 7, wherein said rows of bristles increase in length running away from said first set of bristles.

9. The toothbrush according to claim 8, wherein said bristles comprise poly-plastic bristles.

10. The toothbrush according to claim 8, wherein said rows of bristles range between ⅜–⅝ inches in length.

11. The toothbrush according to claim 1, wherein said transverse notches comprise shallow-angle grooves formed between the middle region and opposing ends to provide more resilience to the ends, allowing them to better conform and straddle a row of teeth.

12. The toothbrush according to claim 1, wherein said opposing ends are each joined to said base at a 30 degree angle.

* * * * *